US007614127B2

(12) United States Patent
Reutter et al.

(10) Patent No.: US 7,614,127 B2
(45) Date of Patent: Nov. 10, 2009

(54) APPARATUS FOR NEEDLING A NON-WOVEN WEB

(75) Inventors: Tilman Reutter, Eidenberg (AT); Andreas Plump, Linz (AT); Robert Strasser, Langenstein (AT)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 12/273,863

(22) Filed: Nov. 19, 2008

(65) Prior Publication Data

US 2009/0119894 A1 May 14, 2009

Related U.S. Application Data

(63) Continuation of application No. PCT/EP2007/004183, filed on May 11, 2007.

(30) Foreign Application Priority Data

May 20, 2006 (DE) ..... 10 2006 023 762

(51) Int. Cl.
*D04H 18/00* (2006.01)

(52) U.S. Cl. ..... 28/114

(58) Field of Classification Search ..... 28/107, 28/114, 113, 112, 108–111, 115; 112/80.4, 112/80.42, 80.41, 80.43, 80.45
See application file for complete search history.

(56) References Cited

U.S. PATENT DOCUMENTS 1,946,030 A * 2/1934 Morton ..... 66/85 R
3,830,174 A 8/1974 Mellor (Continued)

FOREIGN PATENT DOCUMENTS

DE 195 13 392 A1 11/1995

(Continued)

OTHER PUBLICATIONS

The International Search Report for International Application No. PCT/EP2007/004183, mailed Oct. 29, 2007.

*Primary Examiner*—Amy B Vanatta
(74) *Attorney, Agent, or Firm*—Alston & Bird LLP

(57) ABSTRACT

An apparatus for needling a non-woven web. The apparatus comprises at least one needle beam. The needle beam, the lower side of which comprises a needle board having a plurality of needles, is held by a beam support, which is guided by means of a vertical drive for an oscillating movement in an upward and downward movement and is guided by means of a horizontal drive for an oscillating movement in a reciprocating movement. At least two driven eccentric shafts and several connecting rods, which are assigned to the eccentric shafts and the free ends of which are coupled to the beam support, are provided as the vertical drive. The horizontal drive comprises at least one horizontal link, one end of which is connected to the beam support and the opposite end of which is coupled to a gear kinematics, which comprises an eccentric drive. In order to achieve the simplest and most compact possible design of the horizontal drive, the gear kinematics is formed according to the invention by a rocker, one end of which is held on a machine frame by means of a frame swivel joint and the opposite end of which comprises a double swivel joint, said rocker being coupled at the double swivel joint to the horizontal link and the eccentric drive.

17 Claims, 5 Drawing Sheets

U.S. PATENT DOCUMENTS

| | | | | | |
|---|---|---|---|---|---|
| 5,511,294 | A | * | 4/1996 | Fehrer | 28/113 |
| 5,528,805 | A | * | 6/1996 | Leuchtenmuller et al. | 28/115 |
| 5,548,881 | A | * | 8/1996 | Ludwig | 28/114 |
| 5,551,134 | A | * | 9/1996 | Fehrer | 28/115 |
| 5,568,678 | A | * | 10/1996 | Fehrer | 28/115 |
| 5,732,453 | A | * | 3/1998 | Dilo et al. | 28/114 |
| 6,161,269 | A | | 12/2000 | Dilo et al. | |
| 6,266,856 | B1 | * | 7/2001 | Fehrer et al. | 28/107 |
| 6,389,665 | B1 | | 5/2002 | Fuchs et al. | |
| 6,568,051 | B2 | * | 5/2003 | Legl et al. | 28/114 |
| 6,748,633 | B2 | | 6/2004 | Legl et al. | |
| 2003/0056347 | A1 | * | 3/2003 | Pum | 28/107 |
| 2007/0006432 | A1 | * | 1/2007 | Noel et al. | 28/107 |

FOREIGN PATENT DOCUMENTS

| | | | |
|---|---|---|---|
| DE | 100 43 534 | A1 | 4/2001 |
| DE | 202 10 613 | U1 | 11/2002 |
| EP | 0 892 102 | A2 | 1/1999 |

* cited by examiner

APPARATUS FOR NEEDLING A NON-WOVEN WEB

CROSS-REFERENCE TO RELATED APPLICATIONS

The present application is a Continuation of International Application No. PCT/EP2007/004183, filed May 11, 2007, and which designates the U.S. The disclosure of the referenced application is incorporated herein by reference.

BACKGROUND OF THE INVENTION

The invention relates to an apparatus for needling a non-woven web. For strengthening and structuring non-wovens, it is known from the prior art to pierce a non- woven web with a plurality of needles, the needles being guided in an oscillating upward and downward movement. In the process, the needles are thus guided in an oscillating vertical movement in order to strengthen the fiber material on the non-woven web. In this process, the non-woven web is constantly moved forwards in a feed movement. In order to prevent any undesired relative movements between the needle and the non-woven web particularly at high production speeds during the needle penetration, which relative movements result, for example, in a draft or the formation of oblong holes in the needled material, the needles are guided in a superimposed horizontal movement. An apparatus of this type for needling the non-woven web is disclosed, for example, in EP 0 892 102 A1 (U.S. Pat. No. 6,161,269).

SUMMARY OF THE INVENTION

The apparatus disclosed comprises a beam support, on the lower side of which two needle beams, which are disposed side by side, are held for accommodating a plurality of needles. The beam support is held displaceably, a vertical drive being provided for the oscillating movement of the beam support in an upward and downward movement and a horizontal drive being provided for the oscillating movement of the beam support in a linear reciprocating movement. The vertical drive comprises several eccentric shafts and several connecting rods which are guided by the eccentric shafts and the free ends of which engage at the beam support. The horizontal drive comprises at least one horizontal link, one end of which is connected to the beam support and the opposite end of which is assigned to an eccentric drive. In order to be able to change the lift of the horizontal movement of the beam support, the apparatus disclosed provides various possibilities for coupling the horizontal link to the eccentric drive. In a first possibility, the horizontal link is coupled by means of a rocker arm kinematics to a connecting rod guided on an eccentric shaft. The free end of the connecting rod is connected detachably to the rocker arm kinematics so as to be able to adjust a swing path depending on the position of the working point of the connecting rod on the rocker arm. However, it is thus possible to adjust the horizontal lift of the beam support only when the eccentric drive is idle.

In another embodiment of the apparatus disclosed, the oscillating horizontal movement is transmitted to the horizontal link by means of two collateral eccentric drives. The connecting rods guided in parallel are connected by means of a coupling element and a gear kinematics to the horizontal lever, thereby creating a movement amplitude, which results depending on the phase positions of the eccentric shafts of the eccentric drive. It is thus indeed possible to change an adjustment of the horizontal lift during the operation. However this is only possible with considerable instrument-based expenditure, which consecutively increases the space required for the entire apparatus in the case of large plants. Thus at least two separate eccentric drives are required in order to perform only a horizontal reciprocating movement on the beam support.

The apparatus disclosed is thus based on mechanically very complex drive devices, which partially cannot be adjusted in operation to superimpose the vertical movement and guide the beam support in a linear reciprocating movement.

DE 100 43 534 A1 (U.S. Pat. No. 6,389,665) discloses another apparatus for needling a non-woven web, in which apparatus the beam support is formed by a swing pipe, which is pivoted in a reciprocating movement relative to a pivot axis. In this respect, the beam support is pivoted by means of a swivel gear relative to the pivot axis. The apparatus and the swivel gear are therefore not suitable for performing a linear reciprocating movement of the beam support in the horizontal direction.

It is now an object of the invention to provide an apparatus for needling a non- woven web of the type mentioned in the introduction, said apparatus comprising the most compact possible horizontal drive having a simple mechanical structure.

This objective and others are achieved according to the invention by forming the gear kinematics of the horizontal drive by means of a rocker, one end of which is held on a machine frame by means of a frame swivel joint and the opposite end of which comprises a double swivel joint and by coupling the rocker in the double swivel joint to the horizontal link and the eccentric drive.

Advantageous refinements of the invention are defined by the features and combinations of features set forth in the dependent clauses.

One advantage of the invention is that the horizontal link is coupled directly to the eccentric drive by means of a swivel joint, thereby making no additional gear members necessary for the force transmission. The deflection of the double swivel joint brought about by the eccentric drive is determined by the rocker, the opposite end of which is held by means of a frame swivel joint in a position on the machine frame. It is thus also possible to perform rapid horizontal movements of the beam support advantageously and safely, which enable particularly high throughput speeds of the non-woven web and thus high production outputs.

The horizontal lift of the horizontal link occurring during the deflection of the double swivel joint of the rocker is substantially determined by an angular position of the rocker relative to the horizontal link. According to an advantageous refinement of the invention, the frame swivel joint of the rocker is held detachably and displaceably on the machine frame in such a way that it is possible to change a swing angle formed between the rocker and the horizontal link in a neutral position of the beam support. The relative position of the rocker to the horizontal link can thus be changed without interrupting the drive train. The detachment and displacement of the frame swivel joint result directly in a change of the horizontal lift brought about on the horizontal link, the linear reciprocating movement of the beam support being continued by the constant connection of the eccentric drive to the swivel joint. Fine adjustments of the horizontal drive can thus be carried out during operation advantageously and easily particularly at the start of the process.

In order to be able to carry out the most infinitely variable adjustment of the amplitude of the reciprocating movement, the frame swivel joint of the rocker for displacement is held on a guiding device having a circular arc-shaped displacement path according to an advantageous refinement of the invention. The displacement path represents the guideway of the frame swivel joint of the rocker in case the double swivel joint of the rocker is held in the neutral position and the rocker is moved. The pivot point of the horizontal link thus remains substantially unchanged in any lift adjustment. However, it is also possible to select the displacement path such that the pivot point and thus the double swivel joint of the rocker assume various positions in the neutral position.

The design of the guiding device as an adjusting lever, one end of which forms the frame swivel joint of the rocker and the opposite end of which is held on a pivot axis such that the adjusting lever can be pivoted and locked into position, has proved to be particularly useful. Only the position of the adjusting lever is changed by pivoting it about the pivot axis for adjusting the swing movement. The position change of the frame swivel joint of the rocker can be carried out rapidly and safely, it being possible to have reproducible and very fine gradations of the swing adjustment by means of markings on the machine frame.

According to one embodiment of the invention, the end of the horizontal link is disposed in a middle area of the beam support and is connected to the beam support by means of a swivel joint. The thrust and tensile forces introduced for the horizontal deflection can thus be introduced directly on the beam support, irrespective of the vertical movement of the beam support. It is thus possible to prevent stress that is caused by the bending moment and that acts on the beam support.

The position of the horizontal link is notably suitable for realizing a guidance of the beam support in the longitudinal direction. For this purpose, the horizontal link is disposed substantially parallel to a transverse side of the beam support according to an advantageous refinement of the invention and is designed with a reinforcing form such that the beam support is guided in the longitudinal direction. It is thus possible, for example, to operate the apparatus safely even with a non-activated horizontal drive. In this case, the beam support is driven only by the vertical drive for an upward and downward movement.

In order to substantially use compressive forces to create the forces generated in the horizontal link for deflecting the beam support, that refinement of the invention is preferred in which the eccentric drive engages at the double swivel joint in such a way that a movement vector acting on the double swivel joint is directed between the swivel joint on the beam support and the frame swivel joint on the machine frame. When designing the eccentric drive by means of a driven eccentric shaft and a connecting rod, which is connected to the eccentric shaft, and the free end of which is held on the double swivel joint, it is possible to introduce the deflection of the beam support substantially by means of compressive forces in the connecting rod and the horizontal link. Alternatively, however, it is also possible to design the eccentric shaft by means of a crankshaft in order to generate larger translatory movements by means of the eccentric drive.

In one embodiment of the invention, the horizontal link is connected to the double swivel joint of the rocker by means of a coupling kinematics. It is thus possible to reduce the force acting on the horizontal drive. Furthermore, it is possible to stabilize the axial guidance of the needle beam advantageously.

In order to change the magnitude of the lift movement of the needle beam introduced by the rocker, that refinement of the invention has proved to be particularly useful, in which the coupling kinematics is formed of a push rod connected to the rocker and a rocker arm held on a pivot bearing. The push rod and the horizontal link, while being preferably offset to one another, engage at the rocker arm with the result that the swing movement is transferred to the needle beam with a gear ratio. It is thus possible to introduce relatively large lifts on the needle beam even in the case of small swing movements and vice versa.

An advantageous refinement of the invention, in which a free end of the rocker arm comprises a correction mass acting in relation to the needle beam, is characterized in that only a low force transmission is required in order to move the needle beam horizontally. The force reduction enables a lightweight construction of the horizontal drive in which the swivel joints are designed for a corresponding low force transmission.

An advantage of the refinement of the invention, in which the horizontal drive comprises several horizontal links, which are disposed at a distance from one another, and are connected to the beam support while being distributed over the length of the beam support and which are each driven synchronously by an assigned rocker and an assigned eccentric drive, is that the beam support can be guided and moved uniformly over a larger length. It is thus possible to realize larger working widths for treating non- woven webs on the apparatus.

However, it is also possible to realize larger working widths in the apparatus by forming the beam support by means of several support modules and guiding the support modules by means of several drive modules of the horizontal drive. Each of the drive modules comprises at least one of several horizontal links, one of several rockers and one of several eccentric drives. One or more eccentric shafts or crankshafts drive the eccentric drives synchronously. An advantage of the formation of several supports is that it makes it possible to dispense with long and thus bend-sensitive beam supports. Depending on the length of the needle beam, and weight and lift of the beam support, it is possible to alter the number of the support modules or the number of the drive modules over the entire length of the needle beam.

BRIEF DESCRIPTION OF THE DRAWINGS

Figure 1:
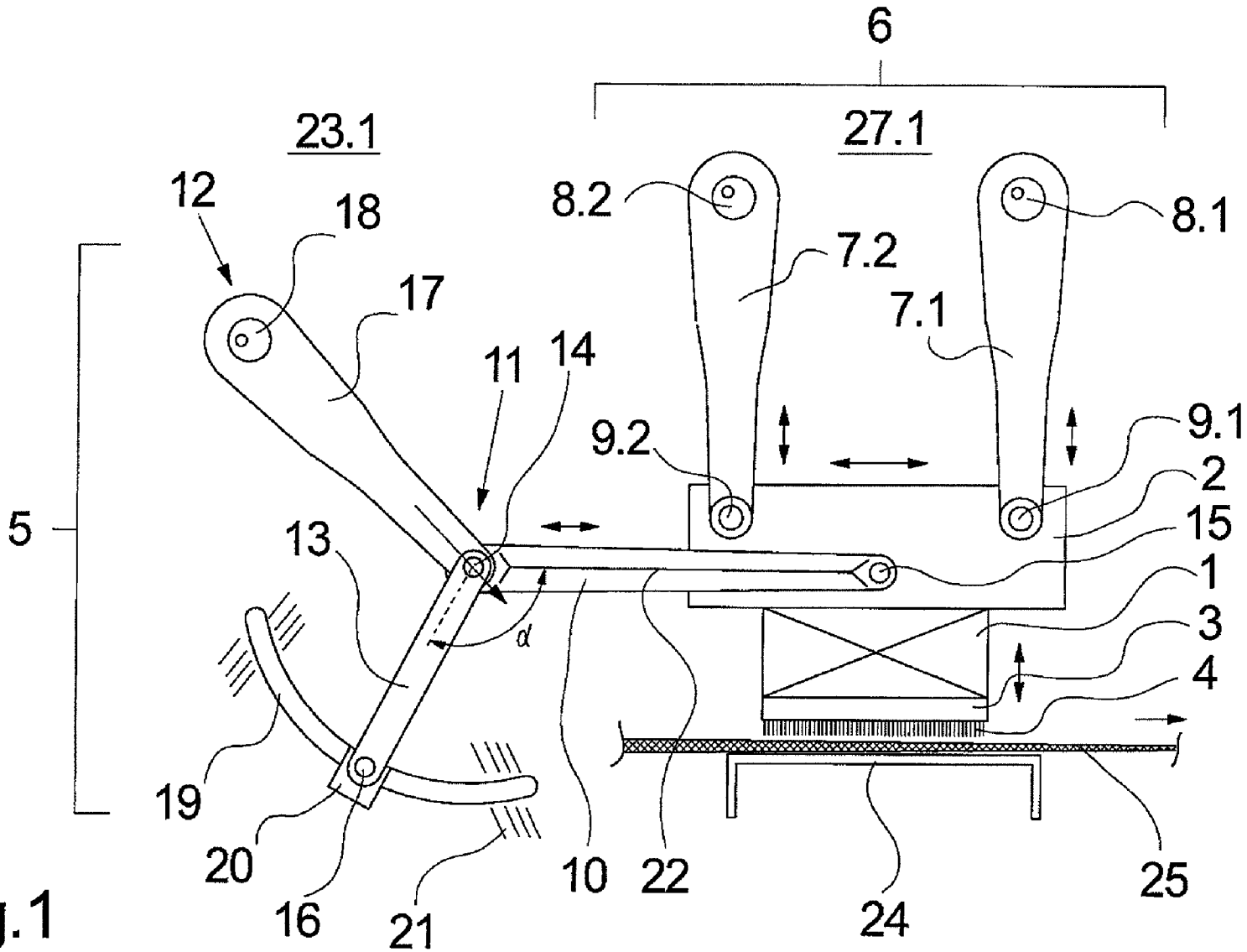
Figure 2:
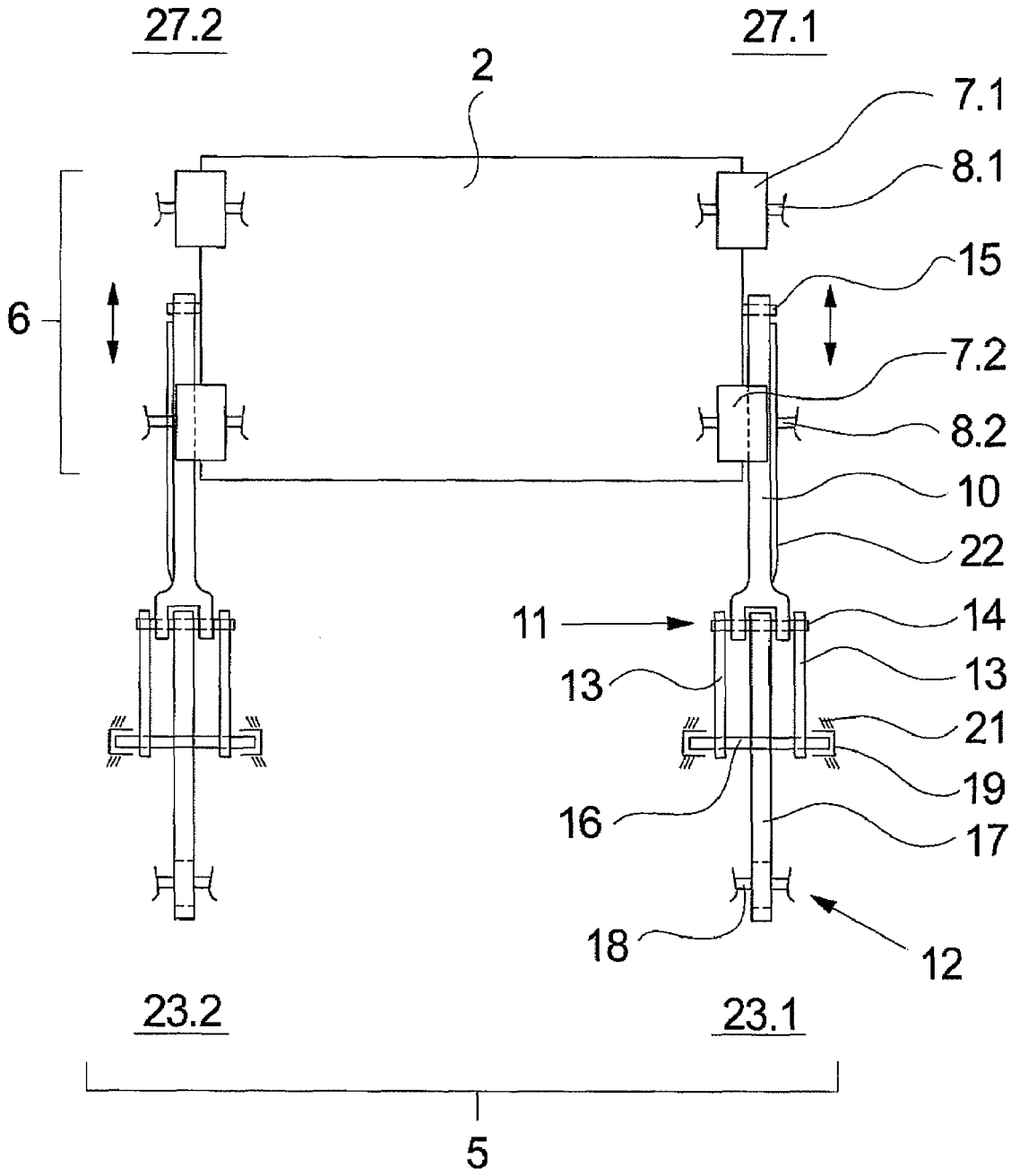
Figure 3:
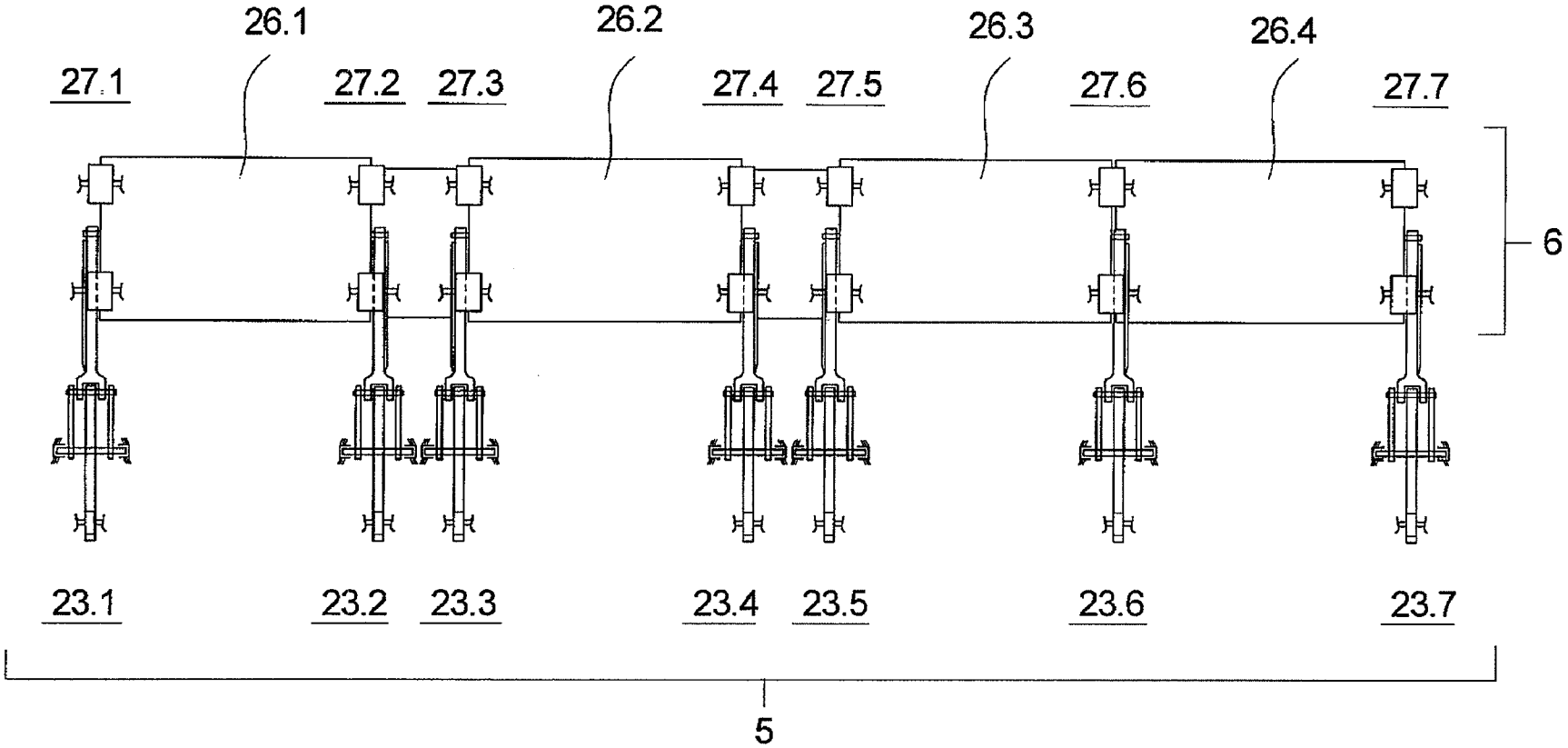
Figure 4:
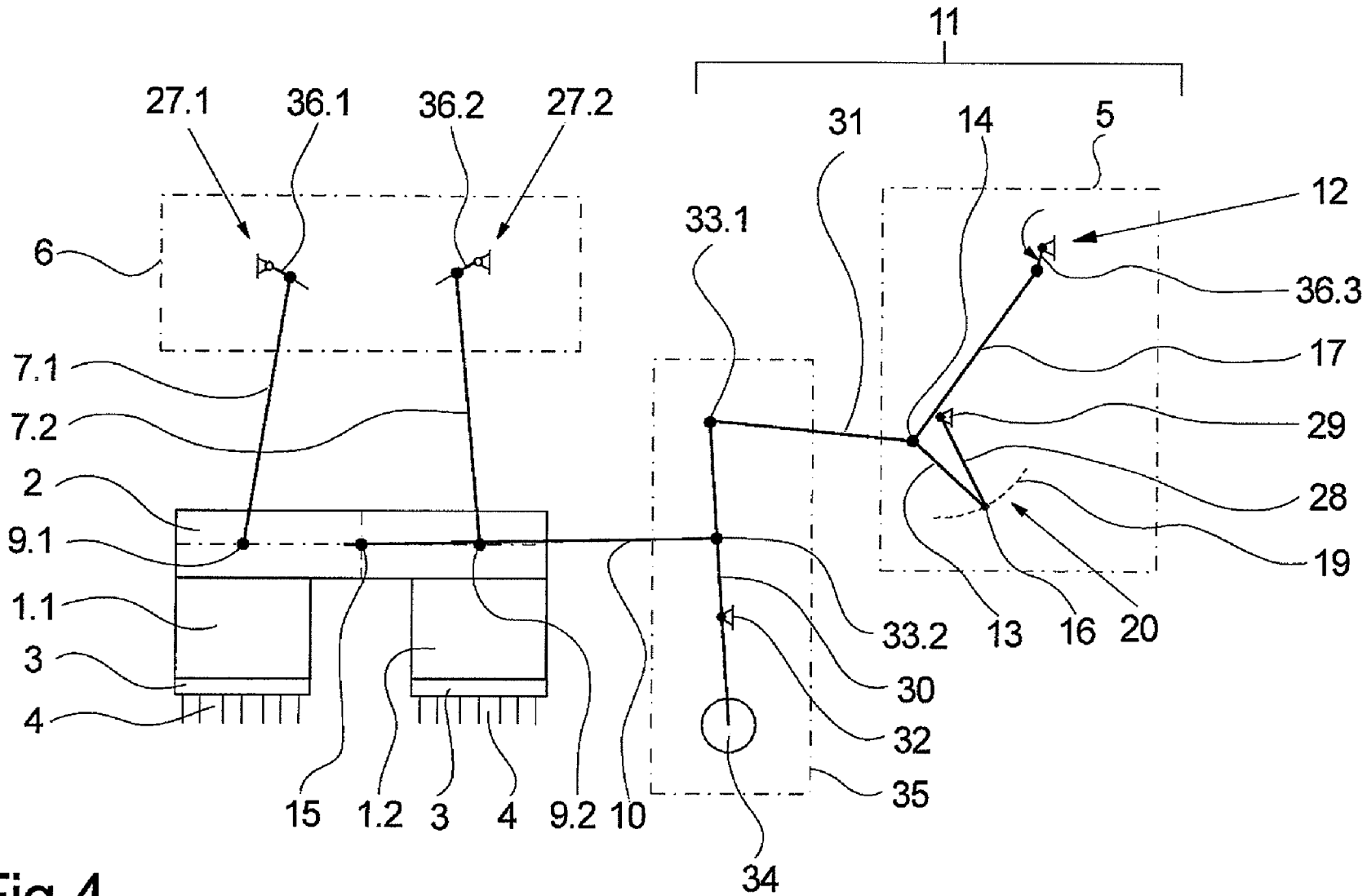
Figure 5:
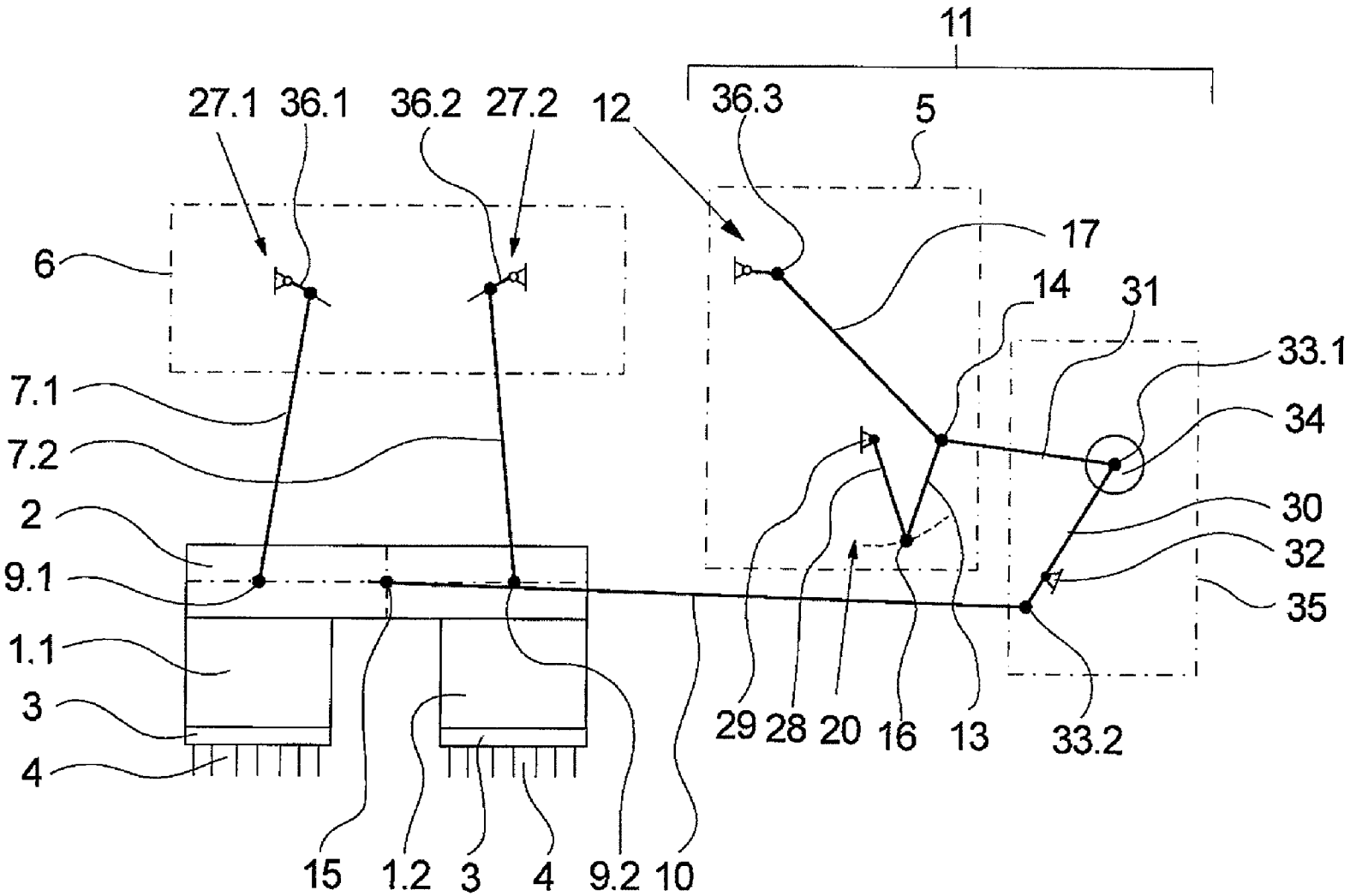

Having thus described the invention in general terms, reference will now be made to the accompanying drawings, which are not necessarily drawn to scale, and wherein:

FIG. 1 shows schematically a side view of a first exemplary embodiment of the apparatus of the invention;

FIG. 2 shows schematically a plan view of the exemplary embodiment of FIG. 1;

FIG. 3 shows schematically a plan view of another exemplary embodiment of the apparatus of the invention;

FIG. 4 shows schematically a side view of another exemplary embodiment of the apparatus of the invention; and FIG. 5 shows schematically a side view of another exemplary embodiment of the apparatus of the invention.

DETAILED DESCRIPTION OF THE INVENTION

The present invention now will be described more fully hereinafter with reference to the accompanying drawings, in which some, but not all embodiments of the invention are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

FIGS. 1 and 2 show a first exemplary embodiment of the apparatus of the invention for needling a non-woven web.

FIG. 1 shows a side view of the exemplary embodiment while FIG. 2 shows a plan view thereof. The following description applies to both figures unless express reference is made to any one of the figures.

The exemplary embodiment of the apparatus of the invention shown in FIG. 1 and 2 comprises a beam support 2, the lower side of which comprises a needle beam 1. The lower side of the needle beam 1 holds a needle board 3 having a plurality of needles 4. A depositing area 24 is assigned to the needle board 3 having the needles 4. A non-woven web 25 is guided between the needle board 3 and the depositing area 24.

A vertical drive 6 and a horizontal drive 5 engage at the beam support 2. The vertical drive 6 moves the beam support 2 in an oscillating manner in the vertical direction with the result that the needle beam 1 with the needle board 3 performs an upward and downward movement. The lift of the vertical movement of the beam support 2 is selected in such a way that the needles 4 held on the lower side of the beam support 2 completely penetrate the non-woven web 25 guided on the depositing area 24. For this purpose, the vertical drive 6 comprises several drive units 27.1 and 27.2, which engage at the beam support 2 while being distributed over the length of the beam support 2. In this exemplary embodiment, two drive units 27.1 and 27.2 of identical structure form the vertical drive 6. Each drive unit 27.1 and 27.2 of the vertical drive 6 comprises two connecting rods 7.1 and 7.2, which are disposed in parallel next to one another and one end of which is connected to the beam support 2 by means of a connecting swivel joint 9.1 and 9.2. The opposite ends of the connecting rods 7.1 and 7.2 are each held on a driven eccentric shaft 8.1 and 8.2. The eccentric shafts 8.1 and 8.2 each form an eccentric drive with the connecting rods 7.1 and 7.2 respectively in order to guide the beam support 2 in an upward and downward movement. The eccentric shafts 8.1 and 8.2 are driven synchronously so as to guide the beam support 2 in a parallel fashion.

For the superimposed horizontal movement of the beam support 2, the horizontal drive 5 having two drive modules 23.1 and 23.2 engages synchronously at the beam support 2. The drive modules 23.1 and 23.2 are each assigned to the transverse sides of the beam support 2. Since the drive modules 23.1 and 23.2 each have an identical structure, only the structure of the drive module 23.1 is explained below.

The horizontal drive 5 is connected to the beam support 2 by means of a horizontal link 10. For this purpose, a free end of the horizontal link 10 is disposed in the middle area of the beam support 2 by means of a swivel joint 15. The opposite end of the horizontal link 10 is coupled to an eccentric drive 12 by means of a gear kinematics 11. The horizontal link 10 is aligned horizontally, the swivel joint 15 being guided on the beam support 2 on a horizontal straight line. The beam support 2 is therefore always articulated at the same point. The gear kinematics 11 comprises a rocker 13, which is connected to the horizontal link 10 and the eccentric drive 12 by means of a double swivel joint 14. For this purpose, the eccentric drive 12 comprises a connecting rod 17, one end of which is disposed on the double swivel joint 14 and the opposite end of which is guided on an eccentric shaft 18. The eccentric shaft 18 is driven by a drive (not shown here).

The opposite end of the rocker 13 is held on a machine frame 21 by means of a frame swivel joint 16. The frame swivel joint 16 is held in a guiding device 20 having a circular arc-shaped displacement path 19, in which the frame swivel joint 16 of the rocker 13 can be guided and locked into position. For this purpose, the guiding device 20 comprises a locking means by which the frame swivel joint 16 can be held in any position within the displacement path 19.

In the situation shown in FIG. 1, the beam support 2 is located in a neutral, non-deflected position. In this neutral position of the beam support 2, a swing angle $\alpha$ is formed between the horizontal link 10 and the rocker 13. Due to the relative position in the rocker 13, the deflection movement transmitted to the double swivel joint 14 by the connecting rod 17 and the eccentric shaft 18 is converted into a definite movement amplitude of the horizontal link 10. The horizontal link 10 guides the beam support 2 in a horizontal reciprocating movement within a predefined lift. The movement vector of the eccentric drive 12, which is indicated by an arrow in FIG. 1, is directed between the swivel joint 15 on the beam support 2 and the frame swivel joint 16 on the machine frame 21. Consequently, a thrust is transmitted by means of the connecting rod 17 for deflecting the horizontal link 10 and thus the beam support 2.

In order to be able to change the lift during the oscillating movement of the beam support 2 in the horizontal direction, the frame swivel joint 16 of the rocker 13 is detached in the guiding device 20 and displaced within the displacement path 19. The swing angle a formed in the neutral position can be reduced or increased in order to achieve a corresponding lift change. A smaller swing angle $\alpha$ would be set at the rocker 13 in order to increase the respective lift. The swing angle $\alpha$ would be increased for a smaller lift in the horizontal direction.

The displacement path of the relative position of the frame swivel joint 16 can be designed individually for each drive module 23.1 and 23.2. However, it is also possible for both the frame swivel joints to have common displacement paths depending on the constructive design of the guiding device 20.

The displacement path 19 of the guiding device 20 is designed in this exemplary embodiment as a circular arc-shaped path, which is set when guiding the rocker 13 about the double swivel joint 14 held in the neutral position. A substantially horizontal alignment of the horizontal link 10 is thus retained over the entire displacement range of the rocker 13. The horizontal link 10 is thus particularly suitable to guide the beam support 2 in the longitudinal direction. For this purpose, the horizontal link 10 has a reinforcing form, which is shown by a reinforcing rib 22 in this exemplary embodiment. The beam support 2 is guided axially by the horizontal links 10 of the drive modules 23.1 and 23.2, the horizontal links 10 being each disposed on the transverse sides of the beam support 2. As a result, the beam support 2 could be operated safely in the extreme case even without activating the horizontal drive 5.

In the exemplary embodiment shown in FIGS. 1 and 2, the vertical drive 6 and the horizontal drive 5 are driven synchronously for needling the non-woven web 25, the downward movement of the beam support 2 being combined with a feed movement so as to enable the needles 4 to perform a movement within the non-woven web 25, said movement being directed in the guiding direction of the non-woven web 25.

The mechanical design of the displacement of the frame swivel joint on the machine frame of the exemplary embodiments explained above is shown by way of example in FIGS. 1 and 2. In principle, all similar mechanical variants are possible in which the frame swivel joint 16 is held stationarily in one position during operation, and in which the stationary position of the frame swivel joint 16 is changed only for changing the lift. It is likewise possible to replace the eccentric drive 12, which engages at the double swivel joint 14, with similar drives, each of which carries out an oscillating movement.

In the exemplary embodiment shown in FIGS. 1 and 2, a needle beam 1 is held on the beam support 2. In principle, however, it is also possible for several needle beams 1 to be disposed on a lower side of a beam support 2. The vertical drive 6 and the horizontal drive 5 can likewise comprise several drive units and drive modules in order to guide the beam support.

FIG. 3 shows an exemplary embodiment in which the beam support 2 is formed by several support modules disposed next to one another. A plan view is shown here of four support modules 26.1 to 26.4 altogether in order to guide one or more needle beams. The vertical drive 6 and the horizontal drive 5 are formed by several drive units and drive modules for the oscillating upward and downward movement and for the oscillating reciprocating movement. In the exemplary embodiments, two drive units of the vertical drive 6 and two drive modules of the horizontal drive 5 are each assigned to the support module 26.1 and 26.2 by way of example. Altogether three drive units of the vertical drive 6 and three drive modules 23.5, 23.6 and 23.7 of the horizontal drive 5 are assigned to the support modules 26.3 and 26.4. The drive units 27.1 to 27.7 and drive modules 23.1 to 23.7 are controlled in a manner that enables them to drive support modules 26.1 to 26.4 synchronously. The number of the support modules, drive units and drive modules can vary depending on the length of the beam, weight, lift and speed in order to achieve optimum use thereof.

The drive units 27.1 to 27.7 of the vertical drive 6 are identical to the exemplary embodiment shown in FIG. 1. Likewise, the drive modules 23.1 to 23.7 have an identical structure, which was explained above for the exemplary embodiment shown in FIG. 1.

FIG. 4 shows schematically the side view of another exemplary embodiment of the apparatus of the invention. Here, all components and assemblies having the same function are provided with identical reference numerals.

In the exemplary embodiment, two needle beams 1.1 and 1.2 are held next to one another on a lower side of a beam support 2. The needle beams 1.1 and 1.2 each comprise a needle board 3 having needles 4. The needle beams 1.1 and 1.2 are assigned to a depositing area (not shown here) on which a non-woven web is guided.

A vertical drive 6 and a horizontal drive 5 engage at the beam support 2. The horizontal drive 5 is connected to the beam support 2 by means of a coupling kinematics 35. The gear kinematics 11 is thus supplemented by the coupling kinematics 35 in order to form the connection between an eccentric drive 12 and a horizontal link 10.

The vertical drive 6 is substantially identical to that of the above exemplary embodiment. Hence only the differences therebetween are explained here. The vertical drive 6 is formed by two drive units 27.1 and 27.2, each of which comprises a connecting rod 7.1 and 7.2 and a crankshaft 36.1 and 36.2. The crankshafts 36.1 and 36.2 are shown schematically as rotatable cranks. The crankshafts 36.1 and 36.2 are connected to connecting rods 7.1 and 7.2 respectively. The connecting rods 7.1 and 7.2 are connected to the beam support 2 by means of the connecting swivel joints 9.1 and 9.2. Due to the rotary motion of the crankshafts 36.1 and 36.2, an upward and downward movement is transmitted to the beam support 2 by means of the connecting rods 7.1 and 7.2, with the result that the needle beams 1.1 and 1.2 are guided in a vertical reciprocating movement for needling a non-woven web.

A horizontal link 10 engages at the beam support 2 by means of a swivel joint 15 for transmitting a horizontal movement of the needle beams 1.1 and 1.2. A coupling kinematics 35 is provided in the opposite free end of the horizontal link 10 in order to connect the horizontal drive 5 to the horizontal link 10. The coupling kinematics 35 in this exemplary embodiment comprises a rocker arm 30, which is pivoted on a pivot bearing 32. The free end of the rocker arm 30 below the pivot bearing 32 comprises a correction mass 34. The horizontal link 10 and a push rod 31 are each connected by means of the swivel joints 33.1 and 33.2 to the rocker arm 30 in that area of the rocker arm 30 which is located above the pivot bearing 32. The swivel joint 33.1, which connects the rocker arm 30 to the push rod 31, is designed on the free end of the rocker arm 30 above the pivot bearing 32. The horizontal link 10, while being offset in relation to the push rod 31, engages at that area of the rocker arm 30, which is located between the swivel joint 33.1 and the pivot bearing 32. The opposite end of the push rod 31 is connected to the rocker 13 of the lift drive 5 by means of the double swivel joint 14.

The lift drive 5 has a substantially identical structure as that of the above exemplary embodiment. Consequently, only the differences therebetween are explained below. The rocker 13 is disposed with the frame swivel joint 16 on a free end of an adjusting lever 28. The adjusting lever 28 forms the guiding device 20 in order to lock the position of the frame swivel joint 16 on the machine frame. For this purpose, the opposite end of the adjusting lever 28 is held on a pivot axis 29, in which the adjusting lever 28 can be pivoted and locked into position. It is thus possible to displace the frame swivel joint 16 on a circular displacement path 19 by displacing the adjusting lever 28.

The rocker 13 is connected in the double swivel joint 14 to the connecting rod 17, the free end of which is connected by means of a crankshaft 36.3. The crankshaft 36.3 forms the eccentric drive 12 in order to drive the connecting rod 17 for moving the rocker 13. The crankshaft 36.3 is shown schematically in FIG. 4 as a pivoted crank.

In the exemplary embodiment shown in FIG. 4, the crankshaft 36.3 and the connecting rod 17 create the swing movement of the rocker 13. The amplitude of the swing movement of the rocker 13 is determined by the location of the frame swivel joint 14 on the machine frame. The movement of the rocker 13 is transmitted to the rocker arm 30 by means of the push rod 31. The rocker arm 30 is pivoted about the pivot bearing 32, with the result that the horizontal link 10 engaging at the middle area of the rocker arm 30 follows the tilting movement of the rocker arm 30. Due to the offset arrangement of the swivel joints 33.1 and 33.2, the push rod 31 and the horizontal link 10, the lift movement created by the horizontal drive 5 is transmitted to the beam support 2 with a gear ratio. In relation to the lift drive 5, the beam support 2 thus performs a lift movement, which is changed by a gear ratio and which is smaller in this case.

The balancing mass 34 designed on the free lower end of the rocker arm 30 counteracts the mass of the beam support 2 during the pivoting movement of the rocker arm 30 so as to achieve a weight compensation in the horizontal direction. As a result of the weight compensation, a relatively small force has to be introduced at the free end of the rocker arm 30 by means of the push rod 31 in order to set the beam support 2 into a reciprocating movement. It is thus possible to reduce the force transmitted into the horizontal drive 5 to a minimum so as to enable corresponding lightweight constructions and compact arrangements.

The exemplary embodiment of the apparatus of the invention shown in FIG. 4 represents only another possible variant in order to connect the horizontal drive 5 to the horizontal link 10 by means of a coupling kinematics 35. Thus, for example, in the exemplary embodiment shown in FIG. 4, the swivel joints 33.1 and 33.2 could be combined with the result that the push rod 31 is coupled directly to the horizontal link 10. In this case, the swing movement of the push rod 31 would be transferred directly to the horizontal link 10 without a gear ratio. A compensation of masses in the horizontal direction is substantially realized by the balancing mass 34 on the rocker arm 30. In principle, however, it is also possible for several horizontal drives to engage simultaneously at a rocker arm. However, the design with a geared-up lift transfer is particularly advantageous, thereby enabling several beam supports to be driven by a lift drive due to the force reduction.

FIG. 5 shows schematically a side view of another exemplary embodiment of the apparatus of the invention. The vertical drive 6, horizontal drive 5 and the coupling kinematics 35 for moving the beam support 2 are substantially identical to those of the above exemplary embodiment shown in FIG. 4. In this respect, reference may be made to the preceding description and only the differences are explained below.

In the exemplary embodiment shown in FIG. 5, the horizontal drive 5 is shown in an arrangement, in which the push rod 31 of the coupling kinematics 35 is moved in the opposite direction in relation to the horizontal link 10. The horizontal drive shown in FIG. 5 is designed mirror-symmetrically in relation to the exemplary embodiment shown in FIG. 4 with the result that the swing movement is performed such that it is turned away from the beam support. This enables a very compact design since the rocker 13 and the connecting rod 17 are located inwardly and thus can approach as close as possible to the vertical drive 6.

The coupling kinematics 35 is disposed on the right side of the machine and enables a very long design of the horizontal link 10. One end of the horizontal link 10 is connected by means of the swivel joint 33.2 to a free end of the rocker arm 30 below the pivot bearing 32. The rocker arm 30 is held on the pivot bearing 32, the rocker arm 30 comprising a relatively short lower lever arm and a substantially larger lever arm above the pivot bearing 32. The push rod 31 is connected by means of the swivel joint 33.1 to the opposite free end of the rocker arm 30 above the pivot bearing 32. Furthermore, the free end of the rocker arm 30 supports the balancing mass 34. Due to this configuration, the push rod 31 has an additionally mass compensating effect for the horizontal movement of the beam support 2.

The design shown in FIG. 5 of the apparatus of the invention is particularly suitable to achieve the most linear possible guidance of the beam support 2 in the horizontal direction. Furthermore, the gear kinematics 11 can be disposed next to the beam support 2 in a particularly compact design.

The apparatus of the invention is particularly suitable to execute a mechanical needling of non-woven webs with high production output and at high production speeds. In particular, the horizontally aligned lift movement helps achieve a high uniform needling quality when structuring non-wovens. Furthermore, a very compact design is achieved with less required space. The simple gear kinematics for activating the horizontal link and the reinforcing form of the horizontal link for the axial guidance of the beam support enable a constructive design having less parts and less weight. It is thus possible to implement very high movement frequencies on the beam carrier 2 since the compact design enables a stiff structure of the machine frame.

The vertical drive and the horizontal drive can be operated synchronously or asynchronously for moving the beam support. The eccentric drive can be driven with any phase tests with the result that flexibility is ensured in the movement control of the beam support. Both eccentric shafts and crankshafts can be used for introducing the drive movement. Preferably several drive units are coupled to one another when using eccentric shafts.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for needling a non-woven web, said apparatus comprising at least one needle beam, the lower side of which comprises a needle board having a plurality of needles, a moveably held beam support for holding the needle beam, a vertical drive connected to the beam support for the oscillating movement of the beam support in an upward and downward movement and a horizontal drive connected to the beam support for the oscillating movement of the beam support in a reciprocating movement, the vertical drive comprising at least two driven eccentric shafts and a plurality of connecting rods, which are assigned to the eccentric shafts and the free ends of which are coupled to the beam support, and the horizontal drive comprising at least one horizontal link, one end of which is connected to the beam support and the opposite end of which is coupled to a gear kinematics, and an eccentric drive coupled to the gear kinematics, wherein the gear kinematics is formed by a rocker, one end of which is held on a machine frame by means of a frame swivel joint and the opposite end of which comprises a double swivel joint and that the rocker is coupled in the double swivel joint to the horizontal link and the eccentric drive.

2. The apparatus according to claim 1, wherein the frame swivel joint of the rocker is held on the machine frame detachably and displaceably such that it is possible to change a swing angle formed between the rocker and the horizontal link in the neutral position of the beam support.

3. The apparatus according to claim 2, wherein the frame swivel joint of the rocker is held for displacement on a guiding device having a circular arc-shaped displacement path, which is set at the end of the rocker during the rotation of the rocker about the double swivel joint held in the neutral position.

4. The apparatus according to claim 3, wherein the guiding device is formed by an adjusting lever, one end of which supports the frame swivel joint of the rocker and the other end of which is held rotatably on a pivot axis and which can be locked into its position.

5. The apparatus according to claim 1, wherein the end of the horizontal link is connected to the beam support in a middle area of the beam support by means of a swivel joint.

6. The apparatus according to claim 5, wherein the horizontal link extends substantially parallel to a transverse side of the beam support and comprises a reinforcing form for guiding the beam support in the longitudinal direction.

7. The apparatus according to claim 1, wherein the eccentric drive engages at the double swivel joint in such a way that a motion vector acting on the double swivel joint is directed between the swivel joint on the beam support and the frame swivel joint on the machine frame.

8. The apparatus according to claim 7, wherein the eccentric drive is formed by a driven eccentric shaft and a connecting rod connected to the eccentric shaft, the free end of the connecting rod being held on the double swivel joint.

9. The apparatus according to claim 8, wherein the eccentric shaft is designed as a crankshaft.

10. The apparatus according to claim 1, wherein the horizontal link is connected to the double swivel joint of the rocker by means of a coupling kinematics.

11. The apparatus according to claim 10, wherein the coupling kinematics is formed by a rocker arm held on the machine frame by means of a pivot bearing and a push rod, one end of the push rod being coupled to the double swivel joint of the rocker and the other end being coupled to the rocker arm, the horizontal link being coupled to the rocker arm.

12. The apparatus according to claim 11, wherein the push rod and the horizontal link, while being offset to one another, are connected to the rocker arm by means of swivel joints.

13. The apparatus according to claim 11, wherein one free end of the rocker arm comprises a balancing mass acting in relation to the needle beam.

14. The apparatus according to claim 1, the horizontal drive comprises several horizontal links, which are disposed at a distance from one another and are connected to the beam support while being distributed over the length of the beam support and which are each driven by an associated rocker and an eccentric drive synchronously.

15. The apparatus according to claim 1, wherein the beam support is formed by a plurality of support modules, which are jointly guided by a plurality of drive modules of the horizontal drive, each drive module comprising at least one of a plurality of horizontal links, one of a plurality of rockers and one of a plurality of eccentric drives.

16. The apparatus according to claim 15, wherein the drive modules are designed to be driven synchronously.

17. The apparatus according to claim 1, wherein the eccentric shafts of the vertical drive are each designed as crankshafts.

* * * * *

UNITED STATES PATENT AND TRADEMARK OFFICE

CERTIFICATE OF CORRECTION

PATENT NO. : 7,614,127 B2
APPLICATION NO. : 12/273863
DATED : November 10, 2009
INVENTOR(S) : Reutter et al.

It is certified that error appears in the above-identified patent and that said Letters Patent is hereby corrected as shown below:

Column 6,
Line 21, "a" should read --α--.

Column 12,
Line 1, "the horizontal" should read --wherein the horizontal--;
Line 2, "several" should read --a plurality of--.

Signed and Sealed this
Fifth Day of April, 2011

David J. Kappos

David J. Kappos
*Director of the United States Patent and Trademark Office*